United States Patent [19]

Lorenz et al.

[11] Patent Number: 4,701,243

[45] Date of Patent: Oct. 20, 1987

[54] METHOD FOR COOLING AND DEDUSTING DRY COOLED COKE

[75] Inventors: Kurt Lorenz, Hattingen; Horst Dungs, Herne; Karl-Hans Auge, Dortmund, all of Fed. Rep. of Germany

[73] Assignee: Firma Carl Still GmbH & Co. KG, Fed. Rep. of Germany

[21] Appl. No.: 832,527

[22] Filed: Feb. 21, 1986

[30] Foreign Application Priority Data

Feb. 21, 1985 [DE] Fed. Rep. of Germany ..... 3505955
Jul. 4, 1985 [DE] Fed. Rep. of Germany ..... 3523897

[51] Int. Cl.[4] ..... C10B 39/12

[52] U.S. Cl. ..... 201/3; 201/39; 202/230; 209/173

[58] Field of Search ..... 201/3, 39, 41; 202/227, 202/228, 229, 230; 209/162, 172, 172.5, 173, 5

[56] References Cited

U.S. PATENT DOCUMENTS

| | | | |
|---|---|---|---|
| 3,800,428 | 4/1974 | Ahland et al. | 201/39 |
| 3,953,928 | 5/1976 | Novy | 201/3 |
| 3,959,084 | 5/1976 | Price | 201/39 |
| 3,969,192 | 7/1976 | Struck | 202/230 |
| 4,308,102 | 12/1981 | Wagener et al. | 201/39 |

FOREIGN PATENT DOCUMENTS

| | | | |
|---|---|---|---|
| 122635 | 11/1946 | Australia | 209/172 |
| 2749408 | 5/1979 | Fed. Rep. of Germany . | |
| 2311081 | 1/1977 | France | 201/39 |
| 54-156006 | 12/1979 | Japan | 201/39 |
| 755865 | 8/1980 | U.S.S.R. | 201/39 |

*Primary Examiner*—Barry S. Richman
*Assistant Examiner*—Joye L. Woodard
*Attorney, Agent, or Firm*—McGlew and Tuttle

[57] ABSTRACT

A method of cooling and dedusting coke after leaving the coke dry cooling system comprises directing the coke at a temperature of approximately 150° to 200° C. into an immersion tank which has a liquid temperature of approximately 100° C., thereafter conveying the coke out of the immersion tank at a selected variable speed so as to free it of fine dust. The water content of the coke after leaving the immersion tank and after an adequate evaporation time is controlled by the speed of the conveyor which is located in the immersion tank and the water content is advantageously kept below 5%, preferably from 0 to 3%. The immersion tank comprises a closed housing overlying a box-shaped tank with a continuously revolving chain conveyor located so as to extend through the tank at its upper reach for conveying the coke into the tank and which has a lower return reach which is directed outside of the tank below the tank itself.

8 Claims, 1 Drawing Figure

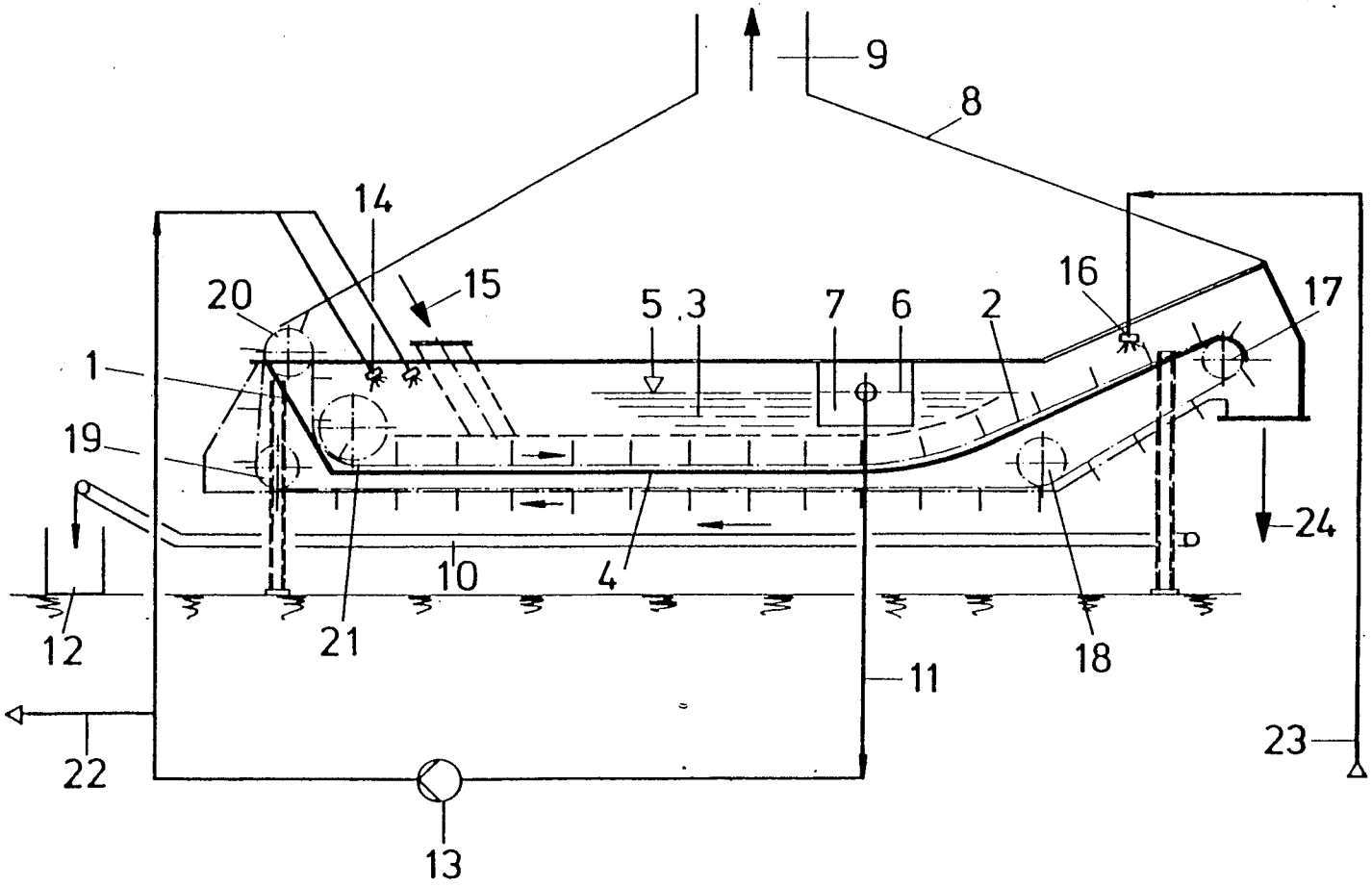
1
2
3
4
5
6
7
8
9
10
11
12
13
14
15
16
17
18
19
20
21
22
23
24

METHOD FOR COOLING AND DEDUSTING DRY COOLED COKE

FIELD AND BACKGROUND OF THE INVENTION

The invention relates in general to coking and in particular to a new and useful method and apparatus for cooling and dedusting coke after leaving a coke dry cooling system, and to an immersion tank to execute the method.

Known from the earlier application No. P 34 29 292 is a method of dedusting dry-cooled coke, in which the fine dust is to be removed from the coke pieces essentially by blowing in air. In addition, the dust is to be loosened from the coke pieces by suitably moving the coke mechanically. In this method, the possibilities are limited, and it cannot be applied everywhere.

From the field of hot briquetting by the ancit method (German OS No. 27 49 408) a method of cooling the hot briquettes at about 500° C. is known, in which they are conveyed by a conveyor belt so as to be immersed in water and shipped after a final cooling. In this method, used exclusively to cool the hot briquettes, the water bath has a temperature of about 40° to 50° C., and the circulating water is cooled additionally in heat exchangers. The problem of dust development does not exist with the briquettes.

SUMMARY OF THE INVENTION

The invention provides an effective method of dedusting dry-cooled coke which eliminates the costly dry dedusting measures.

In accordance with the invention the coke, at a temperature of about 150° to 200° C., is placed in an immersion tank with a liquid temperature of about 100° C. and conveyed out of the immersion tank, preferably at an infinitely variable rate of speed, and thereby freed of the fine dust.

It has turned out that if the coke has a temperature of at least 150° C. when entering the water bath, the bath can be kept at a temperature of about 100° C. so that the coke leaves the water bath after a short while with a temperature of about 100° C. At this coke exit temperature of about 100° C. there is assurance that the water taken along when discharging from the water bath subsequently evaporates again to a large extent.

According to the invention, in particular the water content of the coke after an adequate subsequent water evaporation time i.e. for attaining adjustment equilibrium of the residual water content upon conveying the thus dedusted coke out of the water tank, can be adjusted to less than 5%, preferably less than 3%, in that the speed at which the coke is conveyed through an out of the immersion tank is controlled. Now, it has turned out that a coke immersion time of less than three minutes, preferably even one to twenty seconds, is particularly favorable for obtaining a low and also uniform water content in the coke.

The fact that all fine dusts are separated from the coke pieces in the immersion tank and first absorbed by the water and then conveyed away by the chain conveyor must be viewed as the most important advantage of the method according to the invention.

According to the invention, the coke dusts swimming on the surface of the water are flushed in a coke transport direction and/or towards a screen and/or filtering devices by spraying on circulating water and/or fresh water. These screening and filtering devices are then cleansed in a manner known per se. The coke granules and smaller coke pieces settling on the bottom of the chain conveyor are separated outside of the water bath during the return travel of the chain conveyor, whereby coke granules possibly still clinging to the chain conveyor are flushed away before entry into the immersion tank.

Also, to flush away the superficially adhering fine dusts, the coke leaving the immersion tank should be acted upon by small amounts of water.

The water drained from the immersion tank and possibly from the catch basin under the immersion tank is returned in circulation after an eventual additional cleansing.

To reduce the danger of corrosion and possibly the formation of dust binder it has turned out to be beneficial to add, to the immersion tank, water in small quantities containing, e.g. of of milk of lime or similar substances. The coke may also be sprayed with a dust binder when leaving the immersion tank such as oily or tar containing substances.

To execute the method, an immersion tank is provided which consists of a box-shaped, open tank with a continuously revolving chain conveyor, having a return travel which is outside of the water bath in an opening under the tank bottom. To catch the coke granules and the smaller coke pieces it is expedient to provide a catch basin with a water drain under the immersion tank. To separate the fine, floating substances from the water, the immersion tank has a water overflow with screening and filtering devices and associated cleansing apparatus. These screens and filters are expediently disposed in the area of the coke discharge, preferably in the sidewalls of the immersion tank.

Finally, for the condensation of the vapor clouds rising from the immersion tank, the tank's hood or also the discharge section may be equipped with an indirect water cooling system. In particular, this keeps the water loss due to evaporation low.

Accordingly, it is an object of the invention to provide an improved method of cooling and dedusting coke after it is passed through a coke drying cooling system which comprises directing the coke at a temperature of approximately 150° to 200° C. into an immersion tank which has liquid therein and a temperature of approximately 100° C. and conveying the coke out of the immersion tank at a selected variable speed so that it is freed of fine dust.

A further object of the invention is to provide an immersion tank which includes a tank preferably located in a closed housing in which water is maintained at a selected temperature and which includes a conveyor which has a reach passing through the tank under the level of the water for conveying the coke therethrough and has a return reach extending out of the tank.

A further object of the invention is to provide an immersion tank for the dedusting of coke which is simple in design, rugged in construction and economical to manufacture.

The various features of novelty which characterize the invention are pointed out with particularly in the claims annexed to and forming a part of this disclosure. For a better understanding of the invention, its operating advantages and specific objects attained by its uses, reference is made to the accompanying drawings and descriptive matter in which preferred embodiments of the invention are illustrated.

BRIEF DESCRIPTION OF THE DRAWINGS

In the drawings:

The only FIGURE of the drawings is a schematic sectional view of the immersion tank constructed in accordance with the invention.

DESCRIPTION OF THE PREFERRED EMBODIMENTS

Referring to the drawing, in particular the invention embodied therein comprises an apparatus for cooling and dedusting coke after it is first subjected to a dry cooling in a cooling tower for example, and thereafter dedusted and cooled in accordance with the invention. In accordance with the inventive method, coke is cooled and dedusted after it leaves the dry cooling system by directing it at a temperature of approximately 150° to 200° C. into an immersion tank 1 which is advantageously located within a housing including a head portion or hood 8 overlying the conveyor in the tank having a discharge 9 for gases and steam which includes a spray for cooling the gases. In accordance with a feature of the invention the coke is passed into the immersion tank 1 by directing it on a conveyor such as a chain conveyor which extends downwardly below the liquid level 5 to conduct the coke through the water immersion bath 3 and deliver it over deflection rollers 17 through a discharge in the direction of the arrow 24.

The coke coming from the coke dry cooling system, after leaving the discharge sluices via a suitable conveyor, is fed by a coke feeder 15 into a box-shaped, partly open immersion tank 1 where it is cooled in the water immersion bath 3. By means of a continuously revolving chain conveyor 2 having deflection rollers 17, 18, 19, 20, and 21, the coke is conveyed out of the water bath, and when the chain conveyor is redirected at the deflection roller 17, the coke drops onto another conveyor. After passing over deflection roller 17, the chain conveyor 2 returns empty outside of the immersion tank 1, in the open, under the tank bottom 4.

The coke granules separated from the coke in the water immersion bath 3 are transported out of the immersion bath, together with the coke, by the chain conveyor 2 and drop below the tank bottom 4 onto a conveyor belt 10 to be collected in a coke granule container 12. In the area of the deflection roller 17 of the revolving chain conveyor 2, the coke granule remnants still clinging to the chain conveyor are sprayed off with fresh water 23 from the water nozzles 16.

The fine coke dusts floating on the surface of the water 5 in the area of the coke feeder are flushed in the direction of the coke discharge to the screening and filtering devices by spraying on a part of the circulating water from the water nozzles 14, with the remaining part of the circulating water being optionally withdrawn as waste water 22. The fine coke dust is then conducted together with the water first over a water overflow 6 into a filter basin 7 disposed outside of the coke transport direction and possibly having to be cleaned intermittently. The water is then returned in circulation through the water drain 11 and the circulating pump 13. The entire immersion tank is covered by a hood 8 which has a discharge section 9 on top to discharge the evaporated water. The walls of the hood 8 have an indirect water cooling system so that a part of the rising water vapor is condensed again on the walls. In addition, there are provided in the discharge section 9 cooling devices on which the rising vapor is also cooled and recondensed in part.

While specific embodiments of the invention have been shown and described in detail to illustrate the application of the principles of the invention, it will be understood that the invention may be embodied otherwise without departing from such principles.

What is claimed is:

1. Method of cooling and dedusting dry cooled coke having fine dust adhering thereto, comprising directing dry cooled coke having fine dust adhering thereto at a temperature of approximately 150° to 200° C. into an immersion tank containing water having a liquid temperature of approximately 100° C., and conveying the coke through the water and out of the tank at a selectively controlled variable speed for providing an immersion time of the coke in the water of less than three minutes, wherein said immersion time is sufficient for separating said fine dust adhering to the coke, for maintaining the liquid temperature of said water in the tank at approximately 100° C., and for achieving a residual water content of below 5% in the coke after an adequate water evaporation time for attaining adjustment equilibrium of the residual water content upon conveying the thus dedusted coke out of the tank.

2. Method of claim 1, wherein said speed is controlled for providing an immersion time of the coke in the tank of from 1 to 20 seconds and achieving a residual water content of from 0 to 3% in the coke after said evaporation time.

3. Method of claim 1, wherein the coke is directed into the water in a coke feeding direction at a selective feed location and is conveyed out of the tank at a selective discharge location remote from the feed location, a makeup supply of fresh water is sprayed as a fresh water spray onto the coke being conveyed out of the tank to remove residual adhering fine dust from the coke, a portion of the water in the tank is continuously removed from the tank in the vicinity of the surface of the water at a water overflow location intermediate the coke feed location and coke discharge location and at least a portion of such removed water is recycled as a return water spray which is sprayed onto the surface of the water in the vicinity of the coke feed location, the fresh water spray and return water spray being directed so as to cause the separated fine dust which floats on the surface of the water to be flushed to the water overflow location for removal with the portion of the water being removed from the tank thereat, and the so removed fine dust is screened and filtered from the so removed water prior to recycling of such water as the return spray.

4. Method of claim 1, wherein the coke is conveyed on an endless conveyor through the water and out of the tank, such that the coke travels on the forward reach of the conveyor which is immersed in the tank and such that the return reach of the conveyor is outside of the tank, and the return reach is flushed with water to remove any adhering coke granules therefrom prior to re-entry of the conveyor into the tank as the forward reach thereof.

5. Method of claim 1, wherein the coke being conveyed out of the tank is contacted by a separate spray of water.

6. Method of claim 1, wherein a portion of the water in the tank is continuously removed, cleaned from attendant fine dust and any coke granules, cooled, and then recycled to the tank.

7. Method of claim 1, wherein a neutralizing and dust binding agent is added to the water in the tank.

8. Method of claim 1, wherein the coke being conveyed out of the tank is sprayed with an oily or tar containing dust binding agent.

* * * * *